United States Patent [19]

Jack et al.

[11] Patent Number: 4,509,701

[45] Date of Patent: Apr. 9, 1985

[54] APPARATUS FOR BREAKING UP SOLIDIFIED MATERIAL IN A STORAGE CONTAINER

[75] Inventors: James M. Jack, Georgetown; Stanley W. Mitchell, Windsor, both of Canada

[73] Assignee: Northern Vibrator Manufacturing Limited, Georgetown, Canada

[21] Appl. No.: 524,800

[22] Filed: Aug. 19, 1983

[51] Int. Cl.[3] ..... F23J 3/00

[52] U.S. Cl. ..... 241/292; 30/276; 51/334; 222/228; 300/21; 15/163

[58] Field of Search ..... 15/104.14, 104.2, 163, 15/242, 243, 249; 51/332, 334, 359; 30/276; 222/228, 239; 241/292, 205; 300/21

[56] References Cited

U.S. PATENT DOCUMENTS

| | | | |
|---|---|---|---|
| 3,907,131 | 9/1975 | Lepley | 222/228 X |
| 4,104,796 | 8/1978 | Sheldon | 30/276 |
| 4,412,382 | 11/1983 | White | 30/276 |
| 4,470,168 | 9/1984 | Vickery | 300/21 X |

*Primary Examiner*—Howard N. Goldberg

*Assistant Examiner*—Timothy V. Eley

*Attorney, Agent, or Firm*—Robert F. Delbridge; Arne I. Fors

[57] ABSTRACT

Apparatus for breaking up solidified particulate material in a storage container has a housing lowerable into the container on the lower end of a suspension element. A flailing element holder is rotatably mounted on the housing for rotary movement relative thereto about a substantially vertical axis when the housing is suspended in the container. An elongated flexible flailing element projects from the holder, and the holder is rotated relative to the housing to cause the flailing element to engage and break up solidified particulate material when the housing is suspended in the container. The housing has a torque-balancing device mounted for rotation relatively thereto about a substantially vertical axis, and the torque-balancing device is rotated in a direction opposite to the direction of rotation of the flailing element holder to substantially balance torque produced by rotation of the flailing element holder and thereby substantially prevent angular movement of the housing about a vertical axis when the flailing element holder is rotated.

10 Claims, 9 Drawing Figures

APPARATUS FOR BREAKING UP SOLIDIFIED MATERIAL IN A STORAGE CONTAINER

Figure 1:
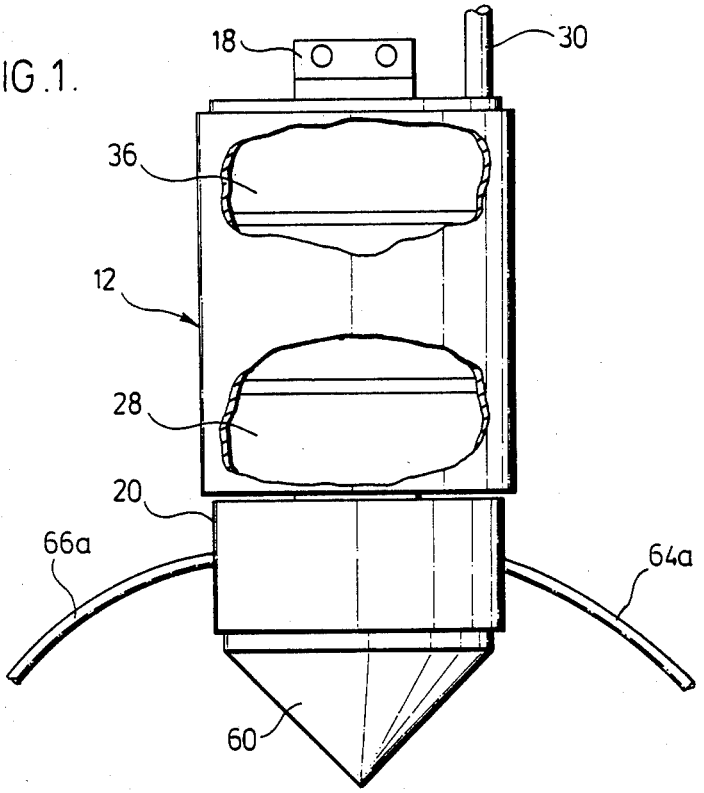

This invention relates to apparatus for breaking up solidified particulate material, such as granular or pulverulent material, in a storage container.

It is common practice to store particulate material such as grain in a container such as a silo or bin, and subsequently remove the material from the container by gravity flow through an opening in the lower part of the container. It is well kown that, depending upon the nature of the material and environmental conditions, the material may solidify in certain areas such as on the sides and bottom of the container. Such solidification may create a blockage which reduces or stops the flow of material from the container through the opening in the lower part. Also, such solidification may occur at the side of the container and adhere to the side wall to create what is commonly known as a hang-up. Hang-ups reduce the storage capacity of the container, and also the problem of incompatibility of materials may arise when a container is used for storing different materials at different times.

It is extremely dangerous for a person to descend into the container to attempt to deal with a blockage or hang-up. Not only may the atmosphere in the container be dangerous because of poisonous fumes or of the risk of explosion due to dust, but there is also the physical danger inherent in such a procedure.

Our U.S. Pat. No. 4,360,276 issued Nov. 23, 1982 describes apparatus for breaking up blockages or hang-ups and which is lowered into a container on the lower end of a suspension element and which operates to produce a vibratory action in a substantially horizontal plane. Although such apparatus is effective for dealing with blockages and hang-ups in various kinds of material, there is still a need for an apparatus which produces a break up action over a greater volume.

It is therefore an object of the invention to provide an improved apparatus for breaking up solidified particulate material in a storage container.

According to the invention, such apparatus comprises a housing lowerable in the container on the lower end of a suspension element, a flailing element holder rotatably mounted on the housing for rotary movement relative thereto about a substantially vertical axis when the housing is suspended in the container, an elongated flexible flailing element projecting from the holder, means for rotating the holder relative to the housing to cause the flailing element to engage and break up solidified particulate material when the housing is suspended in the container, said housing having torque-balancing means mounted for rotation relatively thereto about a substantially vertical axis, and means for rotating the torque-balancing means in a direction opposite to the direction of rotation of the flailing element holder to substantially balance torque produced by rotation of the flailing element holder and thereby substantially prevent angular movement of the housing about a vertical axis when the flailing element holder is rotated.

The means for rotating the flailing element holder may comprise a first fluid pressure operated rotary motor carried by the housing for rotation about a vertical axis, with the apparatus including means for supplying fluid under pressure from an external source to the first rotary motor.

The torque-balancing means may comprise a second fluid pressure operated rotary motor carried by the housing for rotation about a vertical axis, with the fluid supply means also supplying fluid under pressure to the second rotary motor to rotate it in the opposite direction to the first rotary motor. The fluid supply means may supply fluid under pressure to one rotary motor, with this motor having fluid exhaust means from which fluid under pressure is then passed to the other rotary motor.

The flailing element holder may contain a coil of flailing element having a free end portion projecting from the holder for engagement with solidified particular material, the apparatus including means for feeding out further flailing element from the coil when the free end portion is worn away.

The flailing element feed means may comprise element-engaging means mounted on the holder for angular movement relative thereto about a substantially vertical axis to feed further flailing element from the coil, an actuating member reciprocable about a vertical axis, rotatable means associated with the member and with the element-engaging means to cause reciprocating movement of the actuating member to angularly move the element-engaging means in a stepwise manner, and means for reciprocating the actuating member to effect stepwise angular movement of the element-engaging means and thereby feed out further flailing element in a stepwise manner.

The means for effecting reciprocating movement of the actuating member may comprise a fluid pressure operated piston and cylinder means, and means for supplying fluid under pressure thereto from an external source. The fluid supply means may cause operation of the fluid piston and cylinder means in one direction, with the piston and cylinder means also comprising spring means for causing operation of the piston and cylinder means in the opposite direction when the pressure is reduced.

Figure 3:
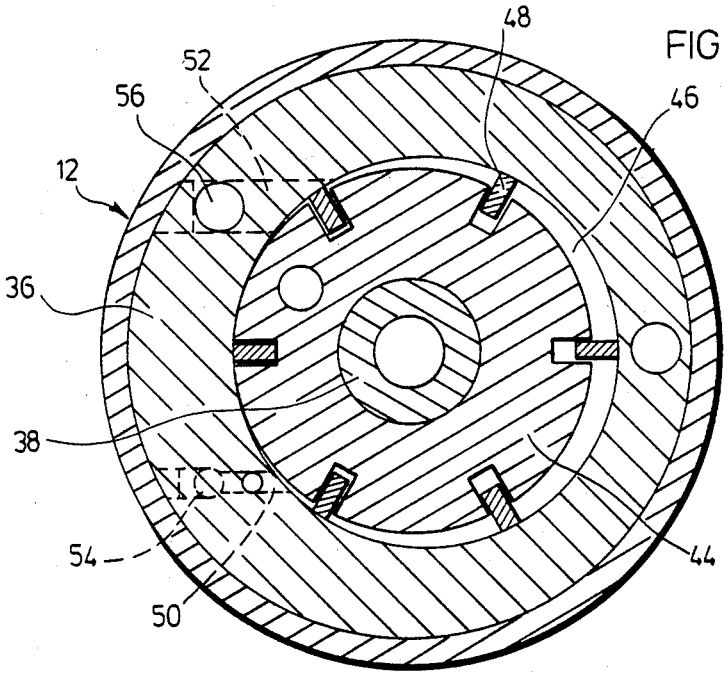
Figure 2:
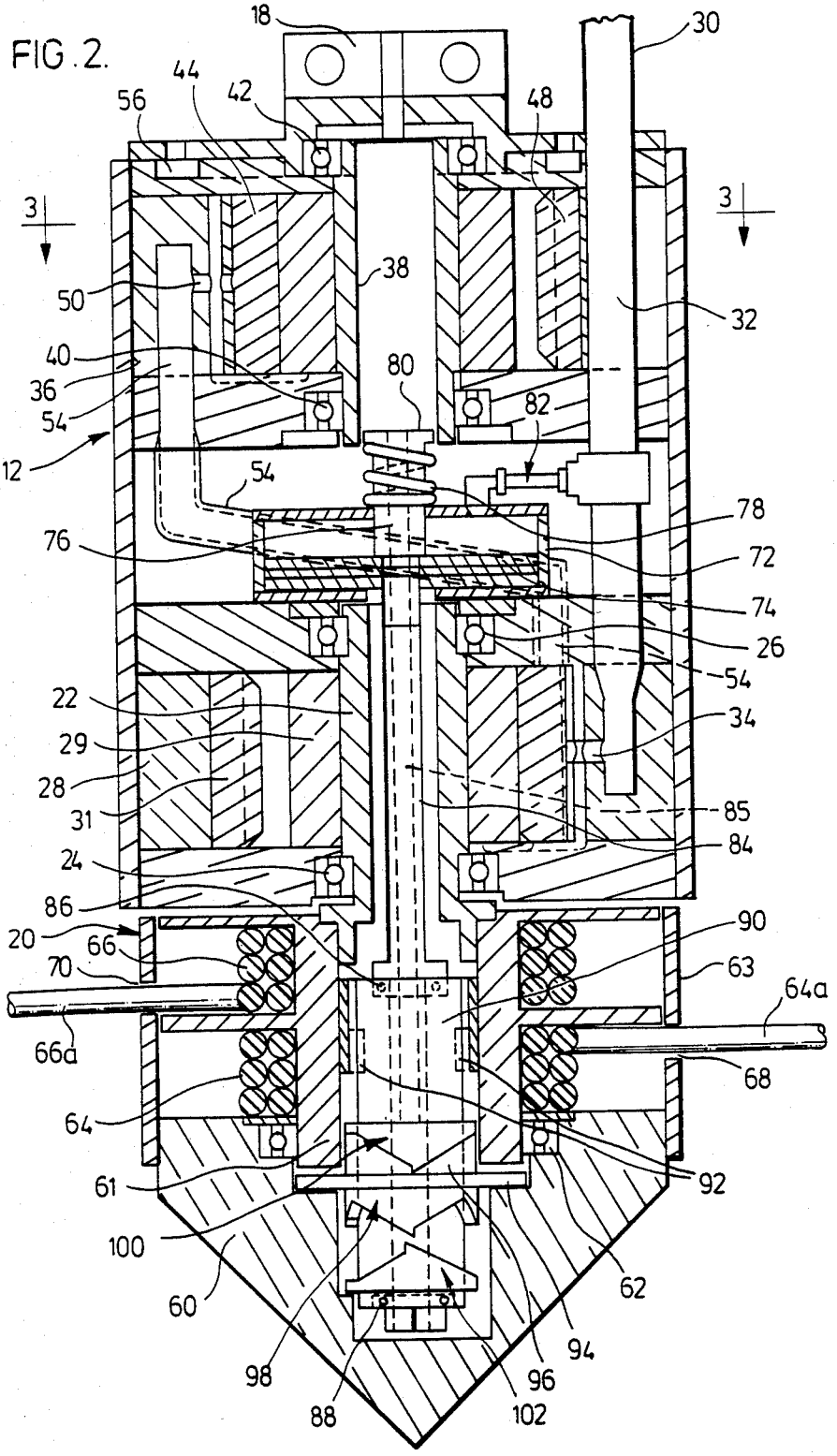
Figure 4:
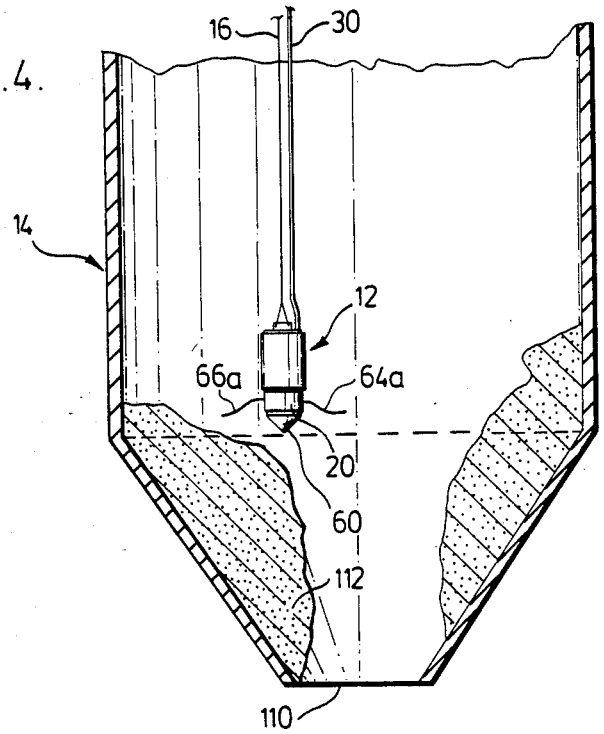
Figure 5:
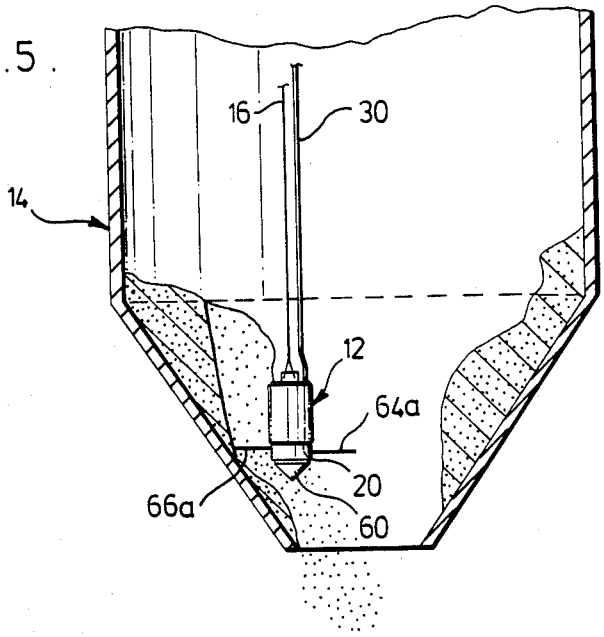
Figure 6:
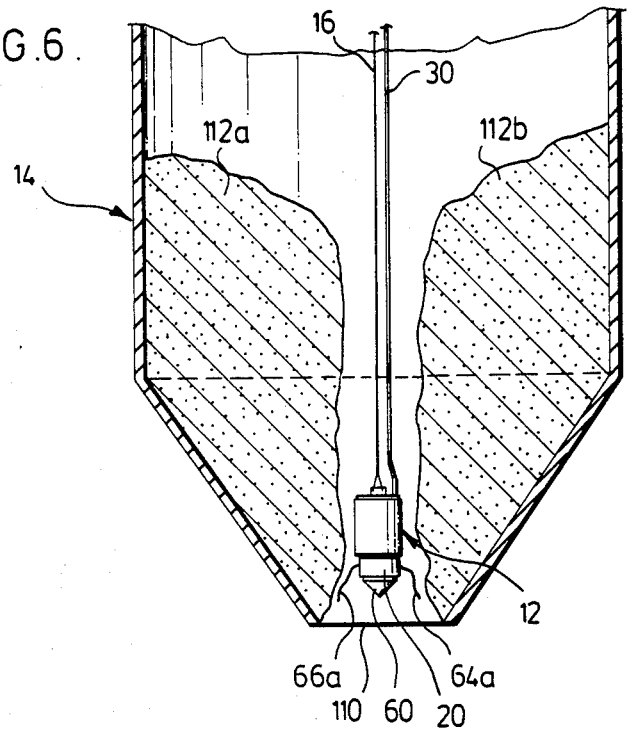
Figure 7:
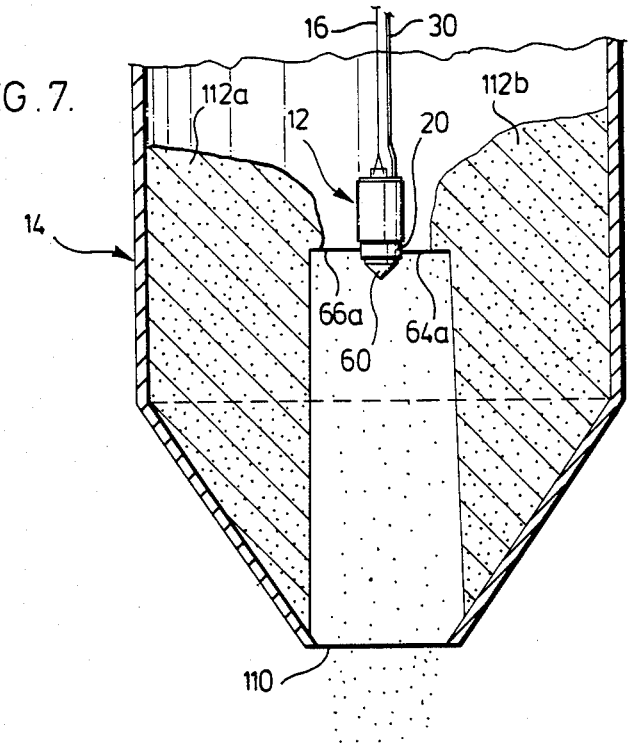
Figure 8:
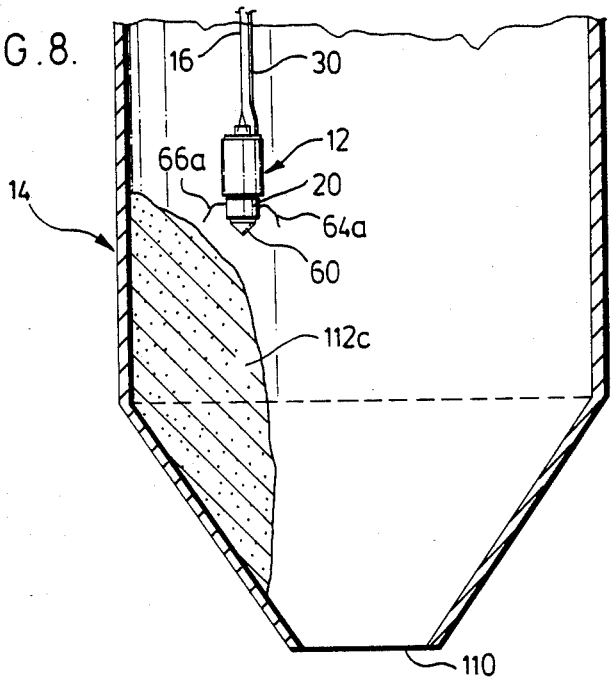
Figure 9:
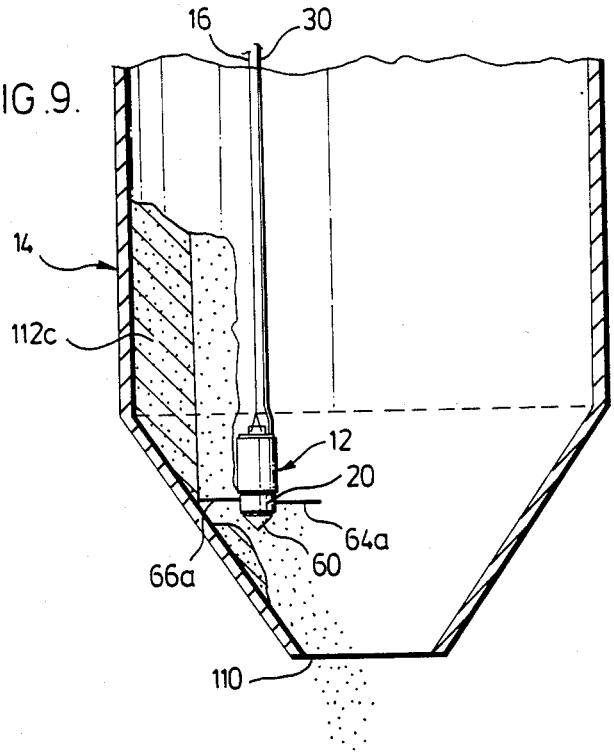

One embodiment of the invention will now be described, by way of example, with reference to the accompanying drawings, of which:

FIG. 1 is a side view (partly broken away) of apparatus for breaking up solidified particulate material in the storage container, FIG. 2 is a vertical sectional view of the apparatus, FIG. 3 is a horizontal sectional view taken along the line 3—3 of FIG. 2, FIGS. 4 and 5 are side views, partly in section, showing use of the apparatus to remove a blockage in the container, FIGS. 6 and 7 are similar views showing another manner in which the apparatus can be used to move a blockage, and FIGS. 8 and 9 are similar views showing use of the apparatus to remove a hang-up in a container.

Referring to the drawings, apparatus for breaking up solidified particulate material in a storage container comprises a housing 12 lowerable in a container 14 (see (FIGS. 4 to 9) on the lower end of a suspension element in the form of a cable 16, the upper end of the housing 18 having a bracket 18 to which the lower end of the cable 18 can be secured.

A flailing element holder 20 is carried by the housing 12 at its lower end and is mounted for rotation relative thereto by means of a hollow shaft 22 which extends upwardly from the holder 20 into the housing 12 and is mounted in vertically spaced bearings 24, 26. The lower part of the housing 12 contains a first air-operated rotary motor 28 mounted on shaft 22 to effect rotation thereof. Air under pressure is supplied to the motor 28 from an external source through an air supply line 30 connected to passage 32 in the housing 12 which leads to a motor inlet 34.

The upper part of the housing 12 contains a second air motor 36 with a hollow vertical shaft 38 mounted in vertically spaced bearings 40, 42. The motor 36 is an unbalanced motor and contains a rotor 44 mounted on shaft 38 which is eccentric with respect to rotor chamber 46, the rotor 44 having radially movable vanes 48 engaging the wall of the chamber 46, and the chamber having an air inlet 50 and air outlet 52. Air exhausted from the first motor 28 passes along passage 54 in a housing 12 to the inlet 50 of the second motor 36, and air exhausting from the second motor outlet 52 passes to the atmosphere through passage 56.

The first motor 28 is of similar construction to the second motor 36, and has rotor 29 and vanes 31, the rotor 29 however not being eccentrically mounted with respect to the motor chamber so that the first motor 28 is a balanced motor. Further details of construction of the first and second motors 28, 36 will be readily apparent to a person skilled in the art.

The flailing element holder 20 has a hollow hub 61 secured to the lower end of shaft 22, and a conical nose cone 60 is mounted on bearing 62 at the lower end of the hub 61 for angular movement relative thereto about a vertical axis. Two vertically-spaced coils of flexible flailing elements 64, 66 are wound around the hub 61, and have free end portions **64*a*, 66*a* projecting outwardly through apertures 68, 70 respectively in a side wall 63 which extends upwardly from the nose cone 60**.

The housing 12 contains a vertically-oriented piston and cylinder arrangement having a cylinder 72 secured to the housing 12 and containing a piston 74 secured to a piston rod 76 which extends above the cylinder 72, with a spring 78 acting between a shoulder 80 on the upper end of piston rod 76 and the top of the cylinder 72 to urge the piston 74 in an upper direction. The air supply passage 32 is also connected to the upper end of cylinder 72 by a branch passage 82, so that air passing into the passage 82 will urge the piston 74 downwardly against the force of the spring 78. An actuating member in the form of a shaft 84 extends downwardly from piston 74 through the hollow motor shaft 22 into the holder 20.

The actuating shaft 84 is mounted in bearings 86, 88 in a sleeve 90 which is vertically movable but non-rotatable relative to the holder 20 by reason of key connections 92. A flange 94 extending around actuating shaft 84 and secured to nose cone 60 carried an upper ratchet-like cam 96 and a lower ratchet-like cam 98 for respective alternate engagement with an upper ratchet-like cam 100 and lower ratcher-like cam 102 carried by sleeve 90.

The operation of the apparatus will now be described. Referring first to FIGS. 1 to 5, the apparatus is lowered by cable 16 to the storage container 14 whose outlet 110 is partly blocked by a hang-up 112. When the apparatus reaches the position shown in FIG. 4, air under pressure is supplied through line 30 and passage 32 to the motor 28 causing rotation of shaft 22 and hence of flailing element holder 20. Thus, the free ends **64*a*, 66*a* of the flailing element 64, 66 are flung outwardly by centrifugal force as the holder 20 rotates. Air exhausting from motor 28 passes to unbalanced motor 36 which is thereby rotated in the opposite direction to balanced motor 28. By reason of its unbalance, motor 36 is therefore doing work, with the torque produced by motor 36 being arranged to balance the torque produced by motor 28 which is rotating flailing element holder 20. At the same time, air under pressure passes through passage 82 into cylinder 72 to position piston 74 in the position shown in FIG. 2**.

The apparatus is then lowered from a position shown in FIG. 4 so that the flailing elements 64, 66 engage and dislodge the portion of the hang-up 112 blocking the outlet 110 as shown in FIG. 5. If the free ends **64*a*, 66*a* of the flailing elements become worn away, the supply of air under pressure is temporarily turned off so that the pressure in the cylinder 72 falls to cause spring 78 to move piston rod 76 upwardly. Thus, cam 102 moves up to engage cam 98 and rotage flange 94, nose cone 60 and side wall 67 by 45° relative to hub 61 in the opposite direction to the winding of the flailing elements 64, 66, thereby uncoiling coils 64, 66 by a relative amount. Air pressure is then restored to cause piston 74 to return to its lower position, with cam 100 then engaging cam 96 to cause a further 45° rotation of flange 94 and consequent further unwinding of the flailing element coils 64, 66. Restoration of air pressure also causes the resumption of operation of the motors 28, 36 with the result that the newly unwound portions of flailing element become flung out by centrifugal force through apertures 68, 70 in the holder 20 to form new free end portions 64*a*, 66*a***.

FIGS. 6 and 7 show how the apparatus can be used to clear an opening blocked by hang-ups **112*a*, 112*b*. In this case, the apparatus is lowered to the opening 110 before starting the motors 28, 36, and is then pulled upwardly with the motors operating as shown in FIG. 7. FIGS. 8 and 9 show use of the apparatus to deal with a hang-up 112*c*** by downward movement.

During lowering movement of the apparatus, the conical nose cone 60 also helps to dislodge solidified material. If desired, air under pressure may be supplied through a passage 85 in shaft 84 to nozzles (not shown) in the cone 60 to further assist such break up. Air may be supplied to the passage 85 from the passage 32 or from the exhaust of motor 36.

Other embodiments of the invention will be readily apparent to a person skilled in the art, the scope of the invention being defined in the appended claims.

What we claim as new and desire to protect by Letters Patent of the United States is:

1. Apparatus for breaking up solidified particulate material in a storage container comprising a housing lowerable into the container on the lower end of a suspension element, a flailing element holder rotatably mounted on the housing for rotary movement relative thereto about a substantially vertical axis when the housing is suspended in the container, an elongated flexible flailing element projecting from the holder, means for rotating the holder relative to the housing to cause the flailing element to engage and break up solidified particulate material when the housing is suspended in the container, said housing having torque-balancing means mounted for rotation relatively thereto about a substantially vertical axis, and means for rotating the torque-balancing means in a direction opposite to the direction of rotation of the flailing element holder to substantially balance torque produced by rotation of the flailing element holder and thereby substantially prevent angular movement of the housing about a vertical axis when the flailing element holder is rotated.

2. Apparatus according to claim 1 wherein the means for rotating the flailing element holder comprises a first fluid pressure operated rotary motor carried by the housing for rotary movement about a vertical axis, and the apparatus includes means for supplying fluid under pressure from an external source to the first rotary motor.

3. Apparatus according to claim 2 wherein the torque balancing means comprises a second fluid pressure operated rotary motor carried by the housing for rotation about a vertical axis, and said fluid supply means also supplies fluid under pressure to the second rotary motor to rotate the second motor in a direction opposite to that of the first rotary motor.

4. Apparatus according to claim 3 wherein said fluid supply means supplies fluid under pressure to one rotary motor, said one rotary motor having fluid exhaust means from which fluid under pressure is then passed from the one motor to the other rotary motor.

5. Apparatus according to claim 3 wherein the torque balancing motor is an unbalanced motor.

6. Apparatus according to claim 1 wherein the flailing element holder contains a coil of flailing element having a free end portion projecting from the holder for engagement with solidified particulate material, and the apparatus includes means for feeding out further flailing element from the coil when the free end portion is worn away.

7. Apparatus according to claim 6 wherein said flailing element feed means comprises element-engaging means mounted on the holder for angular movement relative thereto about a substantially vertical axis to feed further flailing element from the coil, an actuating member reciprocable about a vertical axis, rotatable means associated with the member and with the element-engaging means to cause reciprocating movement of the actuating member to angularly move the element-engaging means in a stepwise manner, and means for reciprocating the actuating member to effect stepwise angular movement of the element-engaging means and thereby feed out further flailing element in a stepwise manner.

8. Apparatus according to claim 7 wherein said means for effecting reciprocating movement of the actuating member comprises a fluid pressure operated piston and cylinder means, and means for supplying fluid under pressure thereto from an external source.

9. Apparatus according to claim 8 wherein said fluid supply means causes operation of the fluid pressure operated means in one direction, and the piston and cylinder means also comprises spring means for causing operation of the piston and cylinder means in the opposite direction when the pressure is reduced.

10. Apparatus according to claim 8 wherein the means for effecting reciprocating movement comprises upper and lower cams carried by the rotating member and alternately engageable with upper and lower cams associated with the element-engaging means.

* * * * *